US005157994A

United States Patent [19]

Krivec

[11] Patent Number: 5,157,994

[45] Date of Patent: Oct. 27, 1992

[54] RATCHET WRENCH WITH LOST MOTION REVERSING MECHANISM

[75] Inventor: Bert Krivec, Wauskesha, Wis.

[73] Assignee: Snap-On Tools Corporation, Kenosha, Wis.

[21] Appl. No.: 807,165

[22] Filed: Dec. 13, 1991

[51] Int. Cl.[5] ..... B25B 13/46

[52] U.S. Cl. ..... 81/63.2; 81/63

[58] Field of Search ..... 81/60–63.2

[56] References Cited

U.S. PATENT DOCUMENTS

| | | | |
|---|---|---|---|
| 2,193,984 | 3/1940 | Rhinevault . | |
| 2,803,980 | 8/1957 | Vogel . | |
| 3,019,682 | 2/1962 | Hare . | |
| 3,145,594 | 8/1964 | Peters . | |
| 3,265,171 | 8/1966 | Kilness . | |
| 3,269,496 | 8/1966 | Kilness . | |
| 4,862,775 | 9/1989 | Chow . | |
| 4,934,220 | 2/1990 | Slusar et al. | 81/63 X |

OTHER PUBLICATIONS

Drawings on Snap-On Tools Corporation Sealed Ratchet Head.

*Primary Examiner*—James G. Smith

*Attorney, Agent, or Firm*—Emrich & Dithmar

[57] ABSTRACT

A reversible ratchet wrench has a housing containing a ratchet wheel and a pawl selectively pivotal between first and second conditions, respectively engageable with the ratchet wheel for accommodating rotation thereof in opposite directions, with the pawl undergoing a ratcheting movement in response to rotation of the ratchet wheel. The pawl is biased by either a torsion band or an over-center leaf spring to the selected condition. A reversing member has a lever arm pivotally movable between first and second positions to pivot the pawl. The pawl and the reversing member respectively have first and second drive portions thereon which respectively form diametrically opposed sectors of a common cylinder, each less than 180° in extent, so as to define a clearance therebetween when the reversing member is in either its first or second position, the second drive portion being engageable with the first drive portion after lost motion through the clearance distance to shift the pawl between its first and second conditions. The clearance between the first and second drive portions is sufficient to accommodate ratcheting movement of the pawl without movement of the reversing member. The lever arm is flexible and resilient and has a cam following finger engageable with a cam surface on the wrench housing to resiliently resist movement of the reversing member from its first or second position.

20 Claims, 2 Drawing Sheets

RATCHET WRENCH WITH LOST MOTION REVERSING MECHANISM

BACKGROUND OF THE INVENTION

1. Field of the Invention

The present invention relates to ratchet wrenches and, in particular to reversible ratchet wrenches and the reversing mechanism thereof.

2. Description of the Prior Art

In a reversible ratchet wrench, a reversing pawl mechanism is engageable with a ratchet wheel in either of two conditions, forward or reverse, for respectively accommodating rotation of the ratchet wheel in opposite directions relative to the wrench housing during the back stroke of the wrench. Typically, a reversing member on the housing is coupled to the pawl mechanism for selective shifting thereof between its forward and reverse conditions. As the ratchet wheel rotates during the back stroke, it effects a ratcheting pivoting movement of the pawl mechanism and, since the pawl mechanism is coupled to the reversing member, this typically effects a corresponding oscillating movement or wobbling of the reversing member. This is disadvantageous, in that the operator often applies his palm to the top of the wrench head on which the reversing member is located and, therefore, contacts the reversing lever. When a fastener is being rotated, the user's palm could inadvertently move the reversing lever such that the pawl is moved to a neutral position whereupon the ratchet wheel is no longer restrained, which could result in injury to the user. Further, the reversing lever could be inadvertently retained in a position corresponding to the maximum oscillation during ratcheting resulting in a partial engagement of the pawl mechanism and ratchet wheel. This condition can cause ratchet wheel breakage at lower than expected torque loads upon reapplying load in the forward direction.

Several techniques have been used to prevent movement of the reversing lever during the back stroke of the wrench. One such technique utilizes a pawl mechanism comprising two separate pawls, arranged so that the one which is engaged with the ratchet wheel is decoupled from the reversing lever. An example of this technique is found in U.S. Pat. No. 2,803,980. Another technique utilizes two different bias springs for the reversing mechanism, one to bias the reversing lever to either one of its forward or reverse positions and the other to bias the pawl mechanism into engagement with the ratchet wheel. The spring force of the latter spring is much less than that of the former, so that the ratcheting does not move the reversing member. An example of this technique is found in U.S. Pat. No. 3,265,171. A third technique designs the parts so that the ratcheting movement of the pawl is in a direction relative to the reversing member such that it does not tend to move the latter. An example of this technique is found in U.S. Pat. No. 3,269,496. All of these techniques necessitate the use of relatively complicated mechanisms comprising a relatively large number of parts.

SUMMARY OF THE INVENTION

It is a general object of the present invention to provide an improved reversible ratchet wrench which avoids the disadvantages of prior wrenches while affording additional structural and operating advantages.

An important feature of the invention is the provision of a reversible ratchet wrench which maintains the reversing lever motionless during operation of the wrench, and yet is of relatively simple and economical construction.

In connection with the foregoing feature, it is another feature of the invention to provide a ratchet wrench of the type set forth, which utilizes a minimal number of parts.

Still another feature of the invention is the provision of a ratchet wrench of the type set forth, which provides a lost motion in the reversing lever sufficient to accommodate the ratcheting movement of the pawl mechanism during operation of the wrench.

These and other features of the invention are attained by providing in a reversible ratchet wrench having a housing containing a ratchet wheel and a pawl mechanism engageable in either of first and second conditions with the ratchet wheel for respectively accommodating rotation thereof in opposite directions relative to the housing during the back stroke of the wrench, with the pawl mechanism undergoing a ratcheting movement in response to rotation of the ratchet wheel during the back stroke, the improvement comprising: a reversing member movable between first and second positions, a first drive portion on the pawl mechanism, and a second drive portion on the reversing member engageable with the first drive portion as the reversing member is moved between its first and second positions for driving the pawl mechanism between its first and second conditions, the first and second drive portions defining a clearance therebetween when the reversing member is disposed in its first or second position sufficient to accommodate the ratcheting movement of the pawl mechanism without moving the reversing member.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

FIG. is a top plan view of a reversible ratchet wrench constructed in accordance with and embodying the features of a first embodiment of the present invention.

DESCRIPTION OF THE PREFERRED EMBODIMENTS

Figure 1:
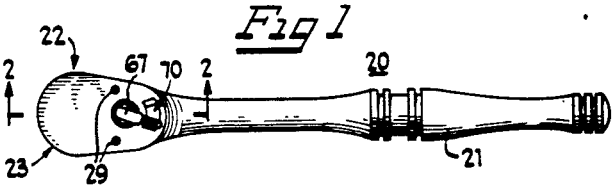
Figure 2:
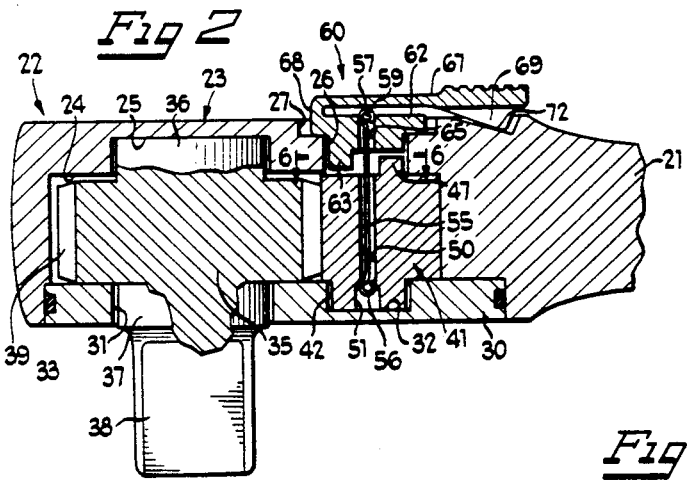
FIG. 2 is an enlarged fragmentary view in vertical section, taken generally along the line 2—2 in FIG. 1.
Figure 3:
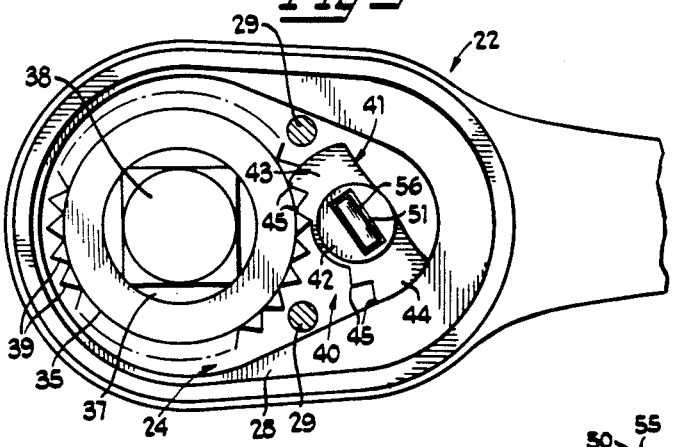
FIG. 3 is a bottom plan view of the portion of the wrench illustrated in FIG. 2 with the cover removed to show the internal construction.

Referring to FIGS. 1-3, there is illustrated a reversible ratchet wrench 20, constructed in accordance with and embodying the features of a first embodiment of the present invention. The wrench 20 includes a handle 21 provided at one end thereof with a head 22. The head 22 includes a housing 23 which is unitary with the handle 21 and is provided with a generally oval-shaped cavity 24 in one face thereof, the cavity 24 having a cylindrical recess 25 at the bottom thereof. Also formed through the bottom wall of the housing 23 is a cylindrical bore 26 having a counterbore 27. A shoulder 28 is formed around the periphery of the cavity 24 adjacent to the outer end thereof.

The housing 23 is connected by screws 29 to a cover plate 30 which, in use, rests upon the shoulder 28 for closing the outer end of the cavity 24. The cover plate 30 has a depth substantially equal to the depth of the shoulder 28 so that the outer face of the cover plate 30 is substantially flush with the adjacent face of the housing 23. The cover plate 30 has a cylindrical bore 31 therethrough coaxial with the recess 25 in the cavity 24. Also formed in the inner surface of the cover plate 30 is a cylindrical recess 32 coaxial with the bore 26 in the housing 23. Preferably, a groove is formed in the outer wall of the cover plate 30 around the periphery thereof and receives therein a suitable sealing ring 33.

A ratchet wheel 35 is disposed in the cavity 24 and has an inner cylindrical hub 36 rotatably seated in the recess 25 and an outer cylindrical hub 37 rotatably received through the bore 31 in the cover plate 30. The outer hub 37 is unitary with an outwardly projecting square drive lug 38 for attachment to associated socket tools in standard fashion. The ratchet wheel 35 is provided with a plurality of peripheral ratchet teeth 39, all in a known manner.

Figure 4:
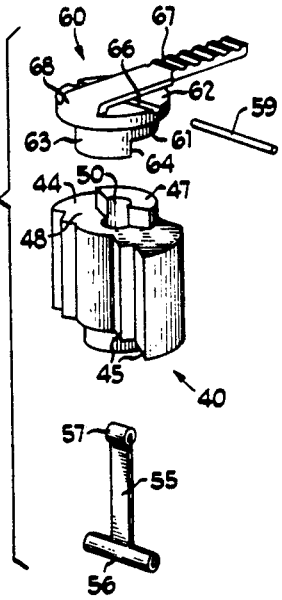
FIG. 4 is an exploded perspective view of the reversing mechanism of the wrench of FIGS. 2 and 3.
Figure 5:
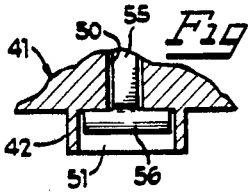
FIG. 5 is a fragmentary view of the lower portion of the reversing mechanism of FIG. 2, rotated 90° clockwise.
Figure 6:
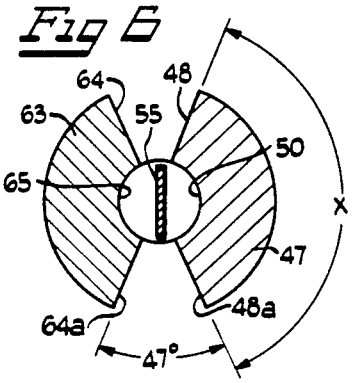
FIG. 6 is an enlarged, fragmentary view in horizontal section, taken generally along the line 6—6 in FIG. 2, illustrating the lost motion feature of the reversing mechanism.

Referring now also to FIGS. 4-6, the wrench head 22 also contains a pawl mechanism 40, which includes a pawl 41 provided with a cylindrical hub 42 which is rotatably seated in the recess 32 in the cover plate 30. The pawl 41 is generally part cylindrical in shape and is cut away at opposite sides to define lobes 43 and 44, each of which is provided with a pair of teeth 45 facing the ratchet wheel 35. Projecting axially from the pawl 41 at the end thereof opposite the hub 42 is a part-cylindrical drive lug 47 which is coaxial with the hub 42 and dimensioned to be disposed rotatably in use in the bore 26 in the housing 23. The drive lug 47 has an arcuate extent substantially less than 180° and defines a pair of radially extending drive surfaces 48 and 48*a*. More specifically, the drive surfaces 48 and 48*a* describe an included angle "X" of less than 150° and, preferably, about 134°.

The pawl 41 has a cylindrical axial bore 50 formed therethrough, provided at the hub end thereof with an elnarged diametrically extending slot or recess 51 (see FIGS. 2 and 5). Disposed in the axial bore 50 is a torsion spring element in the form of a flat, elongated, rectangular band formed of spring steel or the like, the band 55 being provided at the opposite ends thereof, respectively, with loops 56 and 57, the former being elongated and the latter being sized to fit through the axial bore 50. The loop 56 has a length greater than the diameter of the axial bore 50 and is dimensioned to seat in the recess 51 when the loop 57 is inserted through the axial bore 50 from the hub end thereof. Thus, it will be appreciated that the loop 56 serves to limit the depth of insertion of the torsion band 55 in the axial bore 50 and prevents rotation of one end of the torsion band 55 with respect to the pawl 41. Similarly, a flexible pin 59 is receivable through the loop 57 of the torsion band 55 to complete assembly, as will be explained more fully below.

Also disposed in the head 22 is a reversing member 60 which has a circular cylindrical hub 61 which fits rotatably in the bore 26 in the housing 23 from the outer side thereof. Unitary with the hub 61 and extending radially outwardly therefrom at the outer end thereof is a circular flange 62 which is receivable in the counterbore 27. Unitary with the hub 61 at the inner end thereof and extending axially therefrom is a part-cylindrical drive lug 63 which has the same depth and radius as the drive lug 47 on the pawl 41 and cooperates therewith in use to define portions of a common cylinder (see FIG. 6). The drive lug 63 has an angular extent which is preferably substantially the same as that of the drive lug 47 and defines a pair of radially extending drive surfaces 64 and 64*a* which, respectively, face the drive surfaces 48 and 48*a* on the drive lug 47. The reversing member 60 has a cylindrical axial bore 65 extending therethrough which, in use, is disposed coaxially with the bore 50 through the pawl 41. A shallow groove 66 extends diametrically across the outer surface of the flange 62. Unitary with the circular flange 62 is an elongated lever arm 67 which is connected to the circular flange 62 at the perimeter thereof by a unitary upstanding attachment portion 68. Thus, as can best be seen in FIG. 2, the lever arm 67 is spaced a slight distance above the outer surface of the circular flange 62 and extends diametrically thereacross and radially outwardly therebeyond perpendicular to the groove 66. The reversing member 60 is formed of a suitable metal, so that the cantilever attachment of the lever arm 67 results in its having a limited resilient flexibility in directions generally axially of the reversing member 60. Depending from the lever arm 67 at its distal end is a generally triangular cam follower finger 69.

In assembly, after the torsion band 55 has been inserted in the pawl 41, as described above, the drive lug 47 of the pawl 41 is seated in the housing bore 26. Then the hub 61 of the reversing member 60 is fitted in the bore 26 from the outer end thereof, with the loop 57 of the torsion band 55 being received through the axial bore 65 in the reversing member 60. In this regard, it will be appreciated that the length of the torsion band 55 is such that the loop 57 will be disposed at the outer surface of the circular flange 62 when the flange 62 is seated in the counterbore 27, as can best be seen in FIG. 2. The pin 59 is then fitted in the groove 66 and through the loop 57 to hold the assembly together. Preferably, the thickness of the circular flange 62 is substantially the same as the depth of the counterbore 27, so that when the parts are assembled, the outer surface of the circular flange 62 is substantially flush with the adjacent face of the housing 23. Thus, it will be appreciated that the peripheral wall of the counterbore 27 will prevent the pin 59 from accidentally falling out of the loop 57. Then the cover plate 30 is mounted in place, with the pawl hub 42 rotatably seated in the recess 32, and is secured in place with the screws 29.

Figure 7:
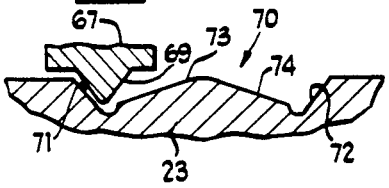
FIG. 7 is an enlarged, fragmentary sectional view illustrating the operation of the reversing lever cam.

Referring also to FIG. 7, the rear face of the housing 23 has a cam indent 70 formed therein just rearwardly of the bore 26. The indent 70 includes cam recesses 71 and 72 dimensioned for accommodating the cam follower finger 69 therein. The cam recesses 71 and 72 are arcuately spaced apart by a raised projection which is generally triangular in transverse cross section and defines inclined cam surfaces 73 and 74. Thus, it will be appreciated that when the cam follower finger 69 is disposed in either one of the cam recesses 71 or 72, the associated cam surfaces 73 or 74 will inhibit pivotal movement of the reversing member 60 about its axis. The limited resilient flexibility of the lever arm 67 will, however, permit the cam follower finger 69 to be cammed past the cam surfaces 73 or 74 and permit pivotal movement of the reversing member 60 by a user between the recesses 71 and 72 which correspond, respectively, to the forward and reverse conditions of the pawl mechanism 40.

Referring now in particular to FIGS. 3, 6 and 7, in operation, the pawl 41 is shiftable between forward and reverse conditions, for respectively engaging the lobes 43 and 44 with the ratchet wheel 35 in standard fashion. When the wrench 20 is rotated through its back stroke, the ratchet wheel 35 ratchets past the pawl 41, imparting to the pawl 41 an oscillatory ratcheting pivotal movement, which is resisted by the torsion band 55, which biases the pawl 41 into engagement with the ratchet wheel 35. Referring in particular to FIG. 7, it can be seen that when the pawl 41 is disposed in a rest position, in either its forward or reverse condition, the reversing member 60 will be disposed in a corresponding position with the cam follower finger 69 disposed in the corresponding one of the cam recesses 70 or 71. When so disposed, there is an angle of approximately 47° between the drive surfaces 64 and **64*a* on the reversing member 60 and the corresponding drive surfaces 48 and 48*a* on the pawl 41 (see FIG. 6). This angular clearance is substantially greater than the angular ratcheting movement of the pawl 41. Thus, the drive lug 47 on the pawl 41 will not engage the drive lug 63 on the reversing member 60 during the back stroke of the wrench 20, so that the reversing member 60 remains motionless during the wrench operation. In this regard, the force of the cam surface 73 or 74 resisting rotation of the reversing member 60 is substantially greater than the torsional force exerted by the torsion band 55 which resist rotation of the pawl 41**.

When it is desired to shift the pawl 41 between its forward and reverse conditions, the lever arm 67 is cammed past the cam surfaces 73 and 74 into the opposite position. This pivoting movement of the reversing member 60 will twist the torsion band 55 and tend to immediately start to rotate the pawl 41. The angular distance between the forward and reverse drive positions of the reversing member 60, i.e., between the cam recesses 71 and 72, is substantially greater than the clearance angle between the drive lugs 63 and 47, so that eve if the action of the torsion band 55 does not rotate the pawl 41 in response to rotation of the reversing member 60, the drive lug 63 will engage the drive lug 47 during the shifting of the reversing member 60 to drive the cam 41 to its opposite condition.

Figure 8:
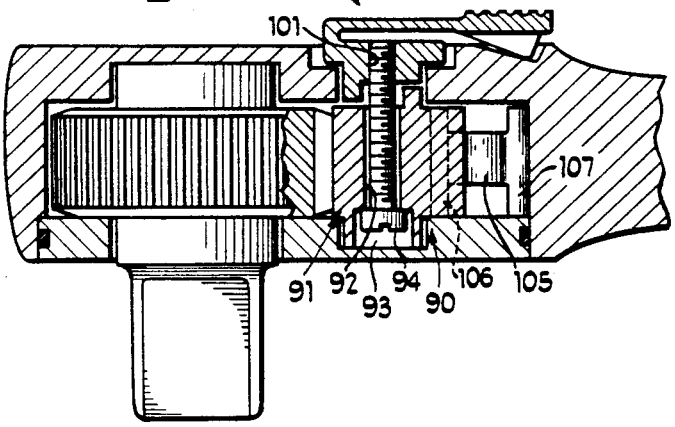
FIG. 8 is a view similar to FIG. 2, illustrating a second embodiment of the invention.
Figure 10:
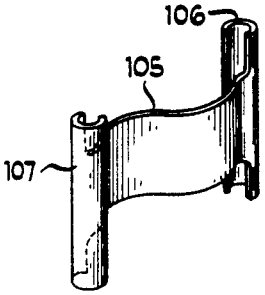
FIG. 10 is a perspective view of the bias spring for the reversing mechanism of the wrench of FIGS. 8 and 9.
Figure 9:
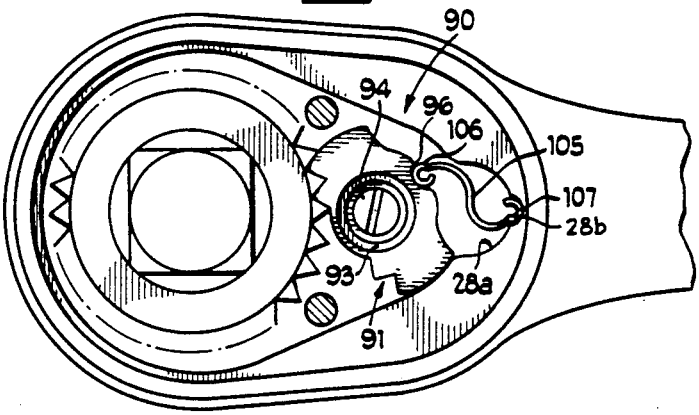
FIG. 9 is a view similar to FIG. 3, illustrating the embodiment of FIG. 8.

Referring now also to FIGS. 8–10, there is illustrated an alternative embodiment of reversing ratchet wrench, generally designated by the numeral 80. The wrench 80 is substantially the same as the wrench 20 and only the differences will be described in detail. The cavity 24 is provided with a part-cylindrical lobe **28*a* with a sub-lobe 28*b* at the handle end thereof. The wrench 80 has a pawl mechanism 90 including a pawl 91 which is essentially the same as the pawl 41, described above, except that it has an axial bore 92 therethrough with a counterbore 93. A suitable fastener, such as a machine screw 94, is received in the bore 92 with its head in the counterbore 93. If desired, a bushing (not shown) may be disposed in the bore 92 around the screw 94. Formed in the rear end of the pawl 91 is a slot 96**, for a purpose to be described more fully below.

The wrench 80 has a reversing member 100 which is substantially the same as the reversing member 60, except that it has an internally threaded axial bore 101 therethrough for threaded engagement with the screw 94 to fasten the reversing member 100 to the pawl 91, the parts being so dimensioned that the facing end surfaces of the pawl 91 and the reversing member 100 do not bear against one another so that they are rotatable relative to each other. The wrench 80 includes a leaf spring 105 which has curved loops or lobes 106 and 107 respectively formed at the opposite ends thereof. The leaf spring 105 has the lobe 106 thereof disposed in the cam slot 96 and has the lobe 107 thereof seated in the cavity sub-lobe **28*b* in the housing 23. The length of the leaf spring 105 is such that it forms a generally S-shaped over-center spring which resiliently biases the pawl 91** into the selected one of its forward and reverse conditions.

When the reversing member 100 is shifted between its forward and reverse positions, the leaf spring 105 will flip over center to its opposite position, thereby reversing the direction of the "S" curve of the spring. Again, the biasing force of the cam action against the cam follower finger 69 of the reversing member 100 is substantially greater than the biasing force of the leaf spring 105, so that the reversing member 100 remains motionless while the pawl 91 ratchets during the back stroke of the wrench 80.

From the foregoing, it can be seen that there has been provided an improved reversible ratchet wrench, which is of simple and econcmical construction and yet effectively prevents movement of the reversing member during the ratcheting back stroke of the wrench.

I claim:

1. In a reversible ratchet wrench having a housing containing a ratchet wheel and a pawl mechanism engageable in either of first and second conditions with the ratchet wheel for respectively accommodating rotation thereof in opposite directions relative to the housing during the back stroke of the wrench, with the pawl mechanism undergoing a ratcheting movement in response to rotation of the ratchet wheel during the back stroke, the improvement comprising: a reversing member movable between first and second positions, a first drive portion on the pawl mechanism, and a second drive portion on said reversing member engageable with said first drive portion as said reversing member is moved between its first and second positions for driving the pawl mechanism between its first and second conditions, said first and second drive portions defining a clearance therebetween when said reversing member is disposed in its first or second position sufficient to accommodate the ratcheting movement of the pawl mechanism without moving said reversing member.

2. The ratchet wrench of claim and further comprising means accommodating pivotal movement of the pawl mechanism and said reversing member.

3. The ratchet wrench of claim 1, wherein the pawl mechanism includes a single pawl member.

4. The ratchet wrench of claim and further comprising bias means for resiliently resisting movement of the pawl mechanism from its first and second conditions.

5. The ratchet wrench of claim 1, wherein said bias means is an over-center leaf spring.

6. The ratchet wrench of claim 4, wherein said bias means is a torsion element.

7. The ratchet wrench of claim and further comprising first bias means resiliently resisting movement of said reversing member from its first and second positions.

8. The ratchet wrench of claim 7, and further comprising second bias means resiliently resisting movement of said pawl mechanism from its first and second conditions, the resisting force of said first bias means being substantially greater than that of said second bias means.

9. In a reversible ratchet wrench having a housing containing a ratchet wheel and a pawl mechanism engageable in either of first and second conditions with the ratchet wheel for respectively accommodating ratcheting rotation thereof in opposite directions relative to the housing during the back stroke of the wrench, the improvement comprising: reversing means coupled to the pawl mechanism and movable between first and second positions for moving the pawl mechanism between the first and second conditions thereof respectively, said reversing means including a flexible resilient lever arm, and cam means cammingly engageable with said lever arm for resisting movement thereof from either the first or the second position thereof, said lever arm being resiliently deflectable by said cam means for accommodating movement of said reversing means between the first and second positions thereof.

10. The ratchet wrench of claim 9, wherein said cam means is formed on the housing.

11. The ratchet wrench of claim 10, wherein said cam means includes a cam surface which is substantially triangular in transverse cross section.

12. The ratchet wrench of claim 11, wherein said lever arm includes a cam follower finger disposed in camming engagement with said cam surface.

13. The ratchet wrench of claim 9, wherein said reversing means includes a hub portion pivotally movable about a pivot axis, said lever arm being cantilevered from said hub portion.

14. The ratchet wrench of claim 13, wherein said lever arm is fixed to said hub portion at the periphery thereof and extends diametrically across said hub portion.

15. The ratchet wrench of claim 9, wherein the pawl mechanism is pivotally movable between its first and second conditions about a pivot axis, said lever arm being resiliently flexible generally axially of the pawl mechanism.

16. In a reversible ratchet wrench having a ratchet wheel and a pawl mechanism pivotally movable between first and second conditions engageable with the ratchet wheel for respectively accommodating rotation thereof in opposite directions, with the pawl mechanism undergoing a ratcheting movement in response to rotation of the ratchet wheel, the improvement comprising: a reversing member movable between first and second positions, a first drive portion on the pawl mechanism, and a second drive portion on said reversing member engageable with said first drive portion as said reversing member is movable between its first and second positions for pivotally moving the pawl mechanism between its first and second conditions, and torsional bias means coupled to the pawl mechanism for resisting pivoting movement thereof from the first or second condition thereof, said first and second drive portions defining a clearance therebetween when said reversing member is disposed in its first or second position sufficient to accommodate the ratcheting movement of the pawl mechanism without moving said reversing member.

17. The ratchet wrench of claim 16, wherein said pawl mechanism includes a single pawl pivotally movable between the first and second conditions thereof about a pivot axis.

18. The ratchet wrench of claim 17, wherein said pawl has an axial bore therethrough, said torsional bias means being accommodated in said axial bore.

19. The ratchet wrench of claim 18, wherein said torsional bias means includes an elongated flat band which is torsionally twisted in response to the pivotal movement of said pawl.

20. The ratchet wrench of claim 19, wherein said torsion band is provided with retaining means at each of its ends respectively engageable in associated grooves on said pawl and said reversing member for movement therewith.

* * * * *

UNITED STATES PATENT AND TRADEMARK OFFICE

CERTIFICATE OF CORRECTION

PATENT NO. : 5,157,994

DATED : October 27, 1992

INVENTOR(S) : Bert Krivec

It is certified that error appears in the above-identified patent and that said Letters Patent is hereby corrected as shown below:

Column 7, line 3, after "claim" insert --1--;

line 8, after "claim" insert --1--;

line 15, after "claim" insert --1--.

Signed and Sealed this

Twelfth Day of October, 1993

Bruce Lehman

*Attest:*

BRUCE LEHMAN

*Attesting Officer*

*Commissioner of Patents and Trademarks*